US011021819B2

(12) United States Patent
Miller et al.

(10) Patent No.: US 11,021,819 B2
(45) Date of Patent: Jun. 1, 2021

(54) ATHLETIC PERFORMANCE GARMENT

(71) Applicant: Under Armour, Inc., Baltimore, MD (US)

(72) Inventors: Merida Miller, Baltimore, MD (US); Maxi Roberts, Baltimore, MD (US)

(73) Assignee: Under Armour, Inc, Baltimore, MD (US)

( * ) Notice: Subject to any disclaimer, the term of this patent is extended or adjusted under 35 U.S.C. 154(b) by 278 days.

(21) Appl. No.: 15/980,514

(22) Filed: May 15, 2018

(65) Prior Publication Data

US 2018/0325196 A1 Nov. 15, 2018

Related U.S. Application Data

(60) Provisional application No. 62/506,389, filed on May 15, 2017.

(51) Int. Cl.

| | |
|---|---|
| ***D04B 21/06*** | (2006.01) |
| ***D06M 17/00*** | (2006.01) |
| ***D04B 1/18*** | (2006.01) |
| ***A41D 1/08*** | (2018.01) |

(52) U.S. Cl.

CPC ..... *D04B 21/06* (2013.01); *A41D 1/08* (2013.01); *D04B 1/18* (2013.01); *D06M 17/00* (2013.01); *A41D 2600/10* (2013.01)

(58) Field of Classification Search

CPC ..... A41D 31/185; A41D 31/18; A41D 31/02; D04B 1/18; D04B 21/06; D04B 21/16; D04B 21/207

See application file for complete search history.

(56) References Cited

U.S. PATENT DOCUMENTS

| | | | | |
|---|---|---|---|---|
| 3,101,717 | A * | 8/1963 | Korman | A41C 3/10 450/39 |
| 4,248,923 | A * | 2/1981 | Ciobanu | D06M 17/00 428/197 |
| 4,795,400 | A * | 1/1989 | Greenberg | A41F 15/007 2/268 |
| 5,201,074 | A * | 4/1993 | Dicker | A63B 21/0552 2/70 |
| 5,263,923 | A | 11/1993 | Fujimoto | |
| 5,367,708 | A | 11/1994 | Fujimoto | |
| 5,385,502 | A * | 1/1995 | Moretz | A41C 3/0014 450/93 |
| 5,447,462 | A | 9/1995 | Smith | |
| 5,640,714 | A | 6/1997 | Tanaka | |

(Continued)

*Primary Examiner* — Danny Worrell

(74) *Attorney, Agent, or Firm* — Maginot, Moore & Beck LLP

(57) ABSTRACT

A garment is configured to be worn on a part of the body. The garment includes a fabric panel, a first material, and a second material. The garment includes an inwardly facing side, which faces toward the part of the body when the garment is worn, and an outwardly facing side, which faces away from the part of the body when the garment is worn. The first material is applied to the outwardly facing side to form a first unit of a first pattern, and the second material is applied to the inwardly facing side to form a second unit of a second pattern. At least one portion of the first unit is repeated to cover at least one first region of the fabric panel, and at least one portion of the second unit is repeated to cover at least one second region of the fabric panel.

20 Claims, 8 Drawing Sheets

(56) References Cited

U.S. PATENT DOCUMENTS 5,916,829 A * 6/1999 Girard ..... A41C 5/00 442/244
5,960,474 A * 10/1999 Dicker ..... A42B 3/0406 2/69
6,047,406 A * 4/2000 Dicker ..... D03D 15/08 2/69
6,186,970 B1 * 2/2001 Fujii ..... A41D 13/0015 602/75
6,231,488 B1 * 5/2001 Dicker ..... A63B 21/0552 482/124
6,306,006 B1 * 10/2001 Cheng ..... A41C 3/10 2/267
6,401,497 B1 6/2002 Nishiyama
6,837,771 B2 * 1/2005 Falla ..... A41B 17/00 2/400
6,874,337 B2 4/2005 Uno
7,043,942 B2 5/2006 Chapman
7,074,204 B2 7/2006 Fujii
7,081,035 B2 7/2006 Kawakami
7,089,597 B2 8/2006 Horii
7,144,294 B2 12/2006 Bell
7,159,621 B2 1/2007 Shannon
7,214,121 B1 * 5/2007 Huang ..... A41C 3/10 450/38
7,228,809 B2 6/2007 Angelino
7,631,367 B2 12/2009 Caillibotte et al.
8,356,363 B2 1/2013 Caillibotte
8,407,814 B2 4/2013 Caillibotte
8,578,514 B2 11/2013 Caillibotte
9,050,179 B2 * 6/2015 Brown ..... A41D 13/0543
9,095,177 B2 * 8/2015 Ota ..... A41D 13/0015
9,345,275 B2 * 5/2016 Albin ..... A41D 31/185
2002/0023709 A1 * 2/2002 Tedeschi ..... A41F 15/007 156/213
2004/0078865 A1 4/2004 Culhane
2004/0151864 A1 8/2004 Thomas
2004/0224603 A1 11/2004 Kaye
2005/0193461 A1 * 9/2005 Caillibotte ..... A63B 21/4001 2/69
2005/0239370 A1 10/2005 Oyama
2006/0099884 A1 5/2006 Falla
2007/0022510 A1 2/2007 Chapuis et al.
2007/0026767 A1 2/2007 Scheininger
2007/0079636 A1 4/2007 Mitchell
2007/0111868 A1 5/2007 Fujii
2007/0214541 A1 9/2007 Kawasaki

* cited by examiner 100
108
112
104

100
112
104

100
108
112
104

100
104
112

100
108
112
104

100
104
112

100
102
104
116
118
120
122
124
126
132A
132B1
132B2
132C1
132C2
136A
136B1
136B2
136C1
136C2
W4
W5
W6
W8
W9
L5
L6

ATHLETIC PERFORMANCE GARMENT

This application claims the benefit of U.S. Provisional Patent Application Ser. No. 62/506,389, filed May 15, 2017, and entitled, "Athletic Performance Garment," the disclosure of which is incorporated herein by reference in its entirety.

BACKGROUND

Interest, and thus investment, in athletic activities has been increasing at every level, from recreational to professional. Accordingly, interest and investment in specialized apparel, accessories, and equipment for participation in athletic activities has also increased. It can generally be said that those participating in athletic activities are interested in enjoying their experiences and improving at their endeavors. Additionally, many athletes are seeking to maximize their performances, gain an edge over their competition, and stay healthy while training and competing.

One way to improve athletic performance and experience is through specialized athletic performance garments. A variety of athletic performance garments have been developed that include particular features designed to enhance and improve athletic performance and experience during a variety of activities. For example, athletic compression garments have been developed that apply a compressive force to the body of the wearer. The compressive force is associated with increased blood flow, increased oxygen delivery, decreased lactic acid build-up, decreased cramping, and shorter recovery time. These effects are associated with improved user experience and athletic performance.

SUMMARY

In accordance with one exemplary aspect of the disclosure, there is provided a garment to be worn on a part of the body. The garment includes a fabric panel, a first material, and a second material. The fabric panel includes an inwardly facing side, which faces toward the part of the body when the garment is worn, and an outwardly facing side, which faces away from the part of the body when the garment is worn. The first material is applied to the outwardly facing side of the fabric panel to form a first unit of a first pattern, and the second material is applied to the inwardly facing side of the fabric panel to form a second unit of a second pattern. At least one portion of the first unit of the first pattern is repeated to cover at least one first region of the fabric panel. At least one portion of the second unit of the second pattern is repeated to cover at least one second region of the fabric panel.

In accordance with another exemplary aspect of the disclosure, there is provided a garment to be worn on a part of the body. The garment includes a fabric panel, which has a fabric modulus of elasticity. The fabric panel includes an inwardly facing side, which faces toward the part of the body when the garment is worn, and an outwardly facing side, which faces away from the part of the body when the garment is worn. The first material is applied to the outwardly facing side of the fabric panel in at least one first region. The at least one first region has a first modulus of elasticity that is greater than the fabric modulus of elasticity. The second material is applied to the inwardly facing side of the fabric panel in at least one second region. The at least one second region has a second modulus of elasticity that is greater than the fabric modulus of elasticity.

In accordance with another exemplary aspect of the disclosure, there is provided a method of producing a garment to be worn on a part of the body. The method includes selectively modifying a modulus of elasticity of a fabric panel of the garment in at least one first region by applying a first material in a first repeating pattern to an outwardly facing side of the fabric panel in the at least one first region. The method further includes selectively modifying the modulus of elasticity of the fabric panel of the garment in at least one second region by applying a second material in a second repeating pattern to an inwardly facing side of the fabric panel in the at least one second region. The outwardly facing side of the fabric panel faces away from the part of the body when the garment is worn, and the inwardly facing side of the fabric panel faces toward the part of the body when the garment is worn.

The above described features and advantages, as well as others, will become more readily apparent to those of ordinary skill in the art by reference to the following detailed description and accompanying drawings. While it would be desirable to provide a garment and associated method that provides improved user experience and athletic performance, the teachings disclosed herein extend to those embodiments which fall within the scope of the appended claims, regardless of whether they accomplish one or more of the above-mentioned advantages.

DETAILED DESCRIPTION

Figure 1B:
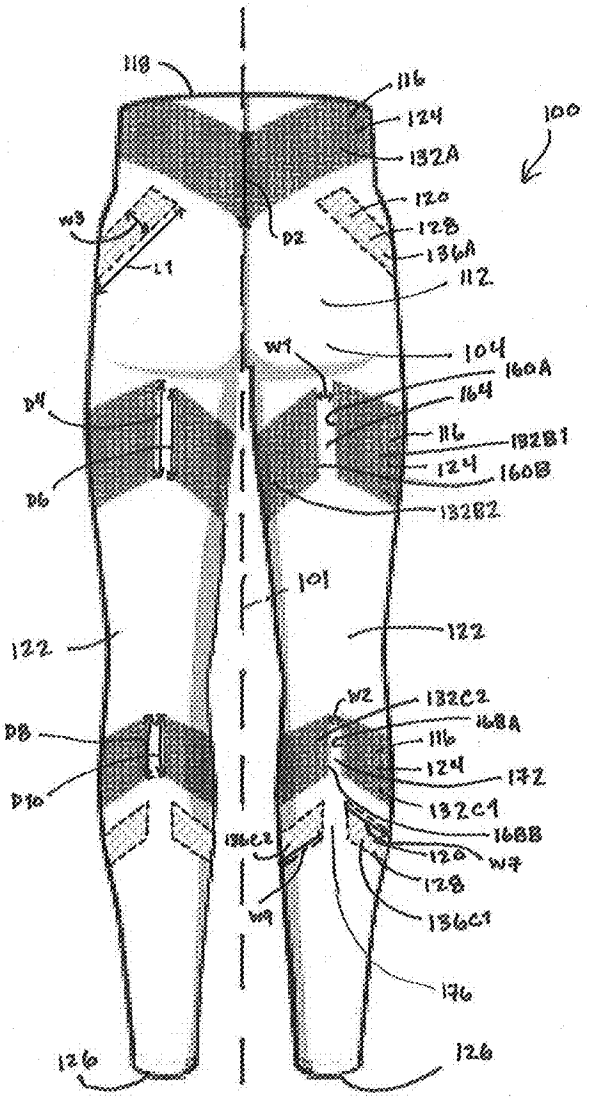
FIG. 1B is a back view of the garment of FIG. 1A including the fabric panel and the first and second materials.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

FIGS. 1A-1H show four embodiments of a garment 100, configured to be worn on a portion of the body. The garment 100 is an athletic performance garment configured to enhance and improve the wearer's athletic performance and experience. The garment 100 includes a fabric panel 104, which has an inwardly facing side 108 (shown, in part, in FIGS. 1A, 1C, 1E, and 1G) and an opposite, outwardly facing side 112. The inwardly facing side 108 faces toward the portion of the user's body when garment 100 is worn, and the outwardly facing side 112 faces away from the portion of the user's body when the garment 100 is worn. As used herein, the fabric panel 104 can include more than one physical piece of fabric material collectively referred to as the fabric panel.

Figure 1A:
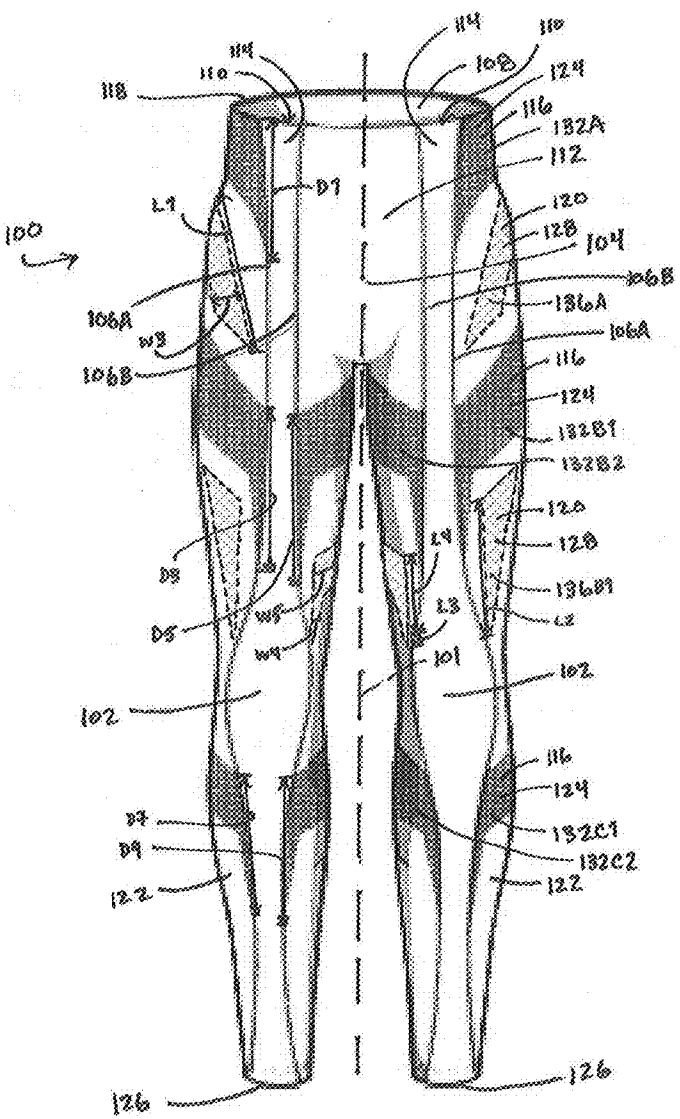
FIG. 1A is a front view of a garment including a fabric panel and first and second materials applied to the fabric panel.

As shown in FIGS. 1A and 1B and described in more detail below, the garment 100 also includes a first material 116, applied to the outwardly facing side 112 of the fabric panel 104, and a second material 120, applied to the inwardly facing side 108 of the fabric panel 104. As described in detail below, application of the first material 116 and the second material 120 to the fabric panel 104 selectively adjusts material properties, and specifically the modulus of elasticity, of the garment 100.

The Garment

Figures 1C, 1D, 1E, 1F, 1G, 1H:
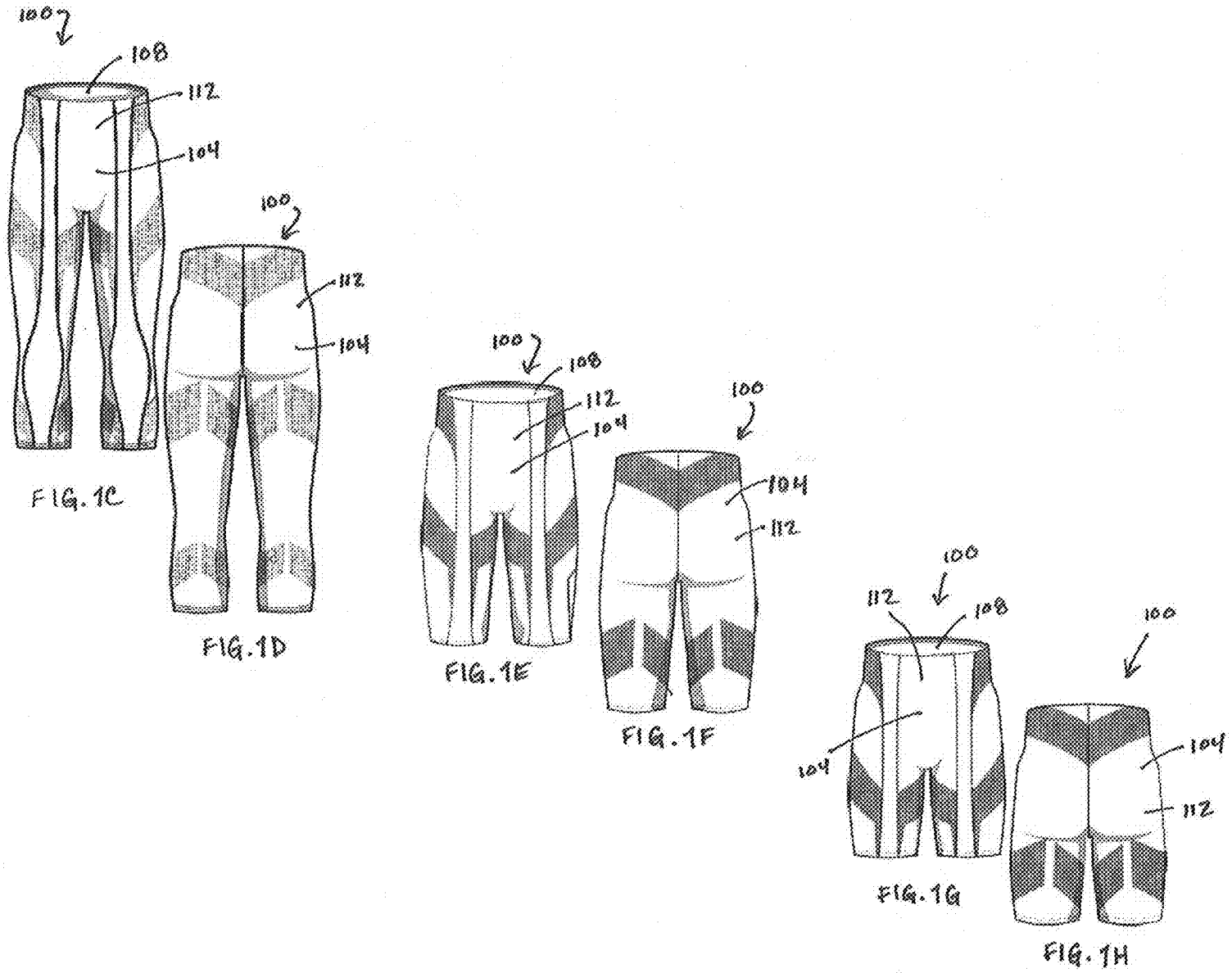
FIG. 1C is a front view of another garment including the fabric panel and the first and second materials.
FIG. 1D is a back view of the garment of FIG. 1C including the fabric panel and the first and second materials.
FIG. 1E is a front view of another garment including the fabric panel and the first and second materials.
FIG. 1F is a back view of the garment of FIG. 1E including the fabric panel and the first and second materials.
FIG. 1G is a front view of another garment including the fabric panel and the first and second materials.
FIG. 1H is a back view of the garment of FIG. 1G including the fabric panel and the first and second materials.

In the exemplary embodiments shown, the garment 100 is configured to be worn on the lower body, and particularly on the wearer's legs and lower torso. In other words, in the examples shown, the garment 100 is a pair of pants, or leggings, or shorts. Accordingly, the garment 100 has: a waistband 118, formed at the top of the garment 100 and configured to accommodate the user's waist; leg portions 122, configured to accommodate each of the user's legs; and leg openings 126, formed at the bottom of the garment 100 and configured to pass each of the user's legs therethrough. The garment 100 is symmetrical over a midline 101. The garment 100 can be a pair of full-length leggings (as shown in FIGS. 1A and 1B), ¾ length leggings (as shown in FIGS. 1C and 1D), shorts having a nine inch inseam (as shown in FIGS. 1E and 1F), shorts having a six inch inseam (as shown in FIGS. 1G and 1H), or another style of pants, leggings, or shorts. Furthermore, in alternative embodiments, the garment 100 can be configured to be worn on another portion of the body. For example, in other embodiments, the garment 100 can be configured as a shirt or a sleeve for an appendage.

In addition to the fabric panel 104, the garment 100 also includes further panels 102, which are non-removably coupled to the fabric panel 104 along seams 106. The further panels 102 can be made of the same material as the fabric panel 104 or of a different material. In an alternative embodiment, the further panels 102 can be integrally formed with the fabric panel 104, and the seams 106 can be included to provide a structural boundary between the further panels 102 and the fabric panel 104. In another alternative embodiment, the garment 100 may be formed without further panels 102. In embodiments including the further panels 102, each of the further panels 102 also has an inwardly facing side 110, which faces in the same direction as the inwardly facing side 108 of the fabric panel 104, and an opposite outwardly facing side 114, which faces in the same direction as the outwardly facing side 112. In FIGS. 1A, 1C, 1E, and 1G, the inwardly facing sides 110 of the further panels 102 are indicated with arrows, which indicate the sides opposite the outwardly facing sides 114, because the inwardly facing sides 110 are not directly visible in these figures. Thus, the further panels 102 and the fabric panel 104 form a continuous inwardly facing side and a continuous outwardly facing side of the garment 100.

The Fabric Panel

In at least one embodiment, the fabric of the fabric panel 104 is a textile including a plurality of strands interconnected via weaving, kitting, braiding, or via a nonwoven process. The strands forming the textile may be any natural or synthetic strands suitable for their described purpose. The term "strand" includes one or more filaments organized into a fiber and/or an ordered assemblage of textile fibers having a high ratio of length to diameter and normally used as a unit of some structure (e.g., slivers, roving, single yarns, plies yarns, cords, braids, ropes, etc.). In a preferred embodiment, a strand is a yarn, i.e., textile fibers or filaments intertwined in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strands, furthermore, may include elastic strands formed of elastomeric material, which possesses the ability to stretch and recover by virtue of its composition. A specific example of an elastomeric material suitable for forming an elastic strand is an elastomeric polyester-polyurethane copolymer such as elastane, which is a manufactured fiber in which the fiber-forming substance is a long chain synthetic polymer composed of at least 85% of segmented polyurethane. It should be noted that an inelastic strand may be modified to possess a topology that enables the strand to provide mechanical stretch and recovery within the textile structure. For example, a hard yarn may be texturized (e.g., crimped) to generate stretch within the yarn.

Preferably, the textile of the fabric panel 104 is a resilient material possessing stretch and recovery properties. That is, the textile structure possesses the ability to expand from its original shape/dimensions (stretch), as well as to contract, returning to its original shape/dimensions (recover). Accordingly, the textile expands when a tension is placed on the textile (e.g., along the machine direction and/or along the non-machine direction). The stretch of the textile may be directional. For example, the textile may possess four-way or two-way stretch capabilities. A textile with "four way" stretch capabilities stretches in a first direction and a second, directly-opposing direction, as well as in a third direction that is perpendicular to the first direction and a fourth direction that is directly opposite the third direction. In other words, a sheet of four-way stretch material stretches in both crosswise and lengthwise. A material with "two way" stretch capabilities, in contrast, stretches to some substantial degree in the first direction and the second, directly opposing direction, but will not stretch in the third and fourth directions, or will only stretch to some limited degree in the third and fourth directions relative to the first and second directions (i.e., the fabric will stretch substantially less in the third and fourth directions than in the first direction and second directions). In other words, a sheet of two-way stretch material stretches either crosswise or lengthwise.

Compression and Modulus of Elasticity

The garment 100 is configured as a compression garment. Accordingly, the fabric panel 104 applies a compressive force to the portion of the wearer's body on which the garment 100 is worn. More specifically, the fabric panel 104 has a modulus of elasticity, which is determined by the particular material(s) and structure(s) that make up the fabric of the fabric panel 104. The modulus of elasticity of a material determines how easily it is deformed upon the application of force. The greater the modulus of elasticity of a material, the more difficult it is to deform. The amount of compression applied to the user's body also depends, in part, on the size of the user's body relative to the garment 100. In some embodiments, the garment 100 can be a tightly fitting garment that is not necessarily a compression garment.

In at least one embodiment, the fabric panel 104 is made up of a woven fabric including elastic strands made of an elastomeric material, such as spandex or elastane. The resulting modulus of elasticity of the fabric panel 104 is low enough that the fabric panel 104 deforms under the force applied by the presence of the user's body within the garment 100 in order to accommodate the portion of the user's body within the garment 100. The modulus of elasticity of the fabric panel 104 is also high enough that the fabric panel 104 applies a compressive force to the user's body within the garment 100.

The further panels 102 can be made of the same fabric material as the fabric panel 104 or a different material. Furthermore, the further panels 102 can have the same modulus of elasticity as the fabric panel 104 or a different modulus of elasticity. The modulus of elasticity of the further panels 102 is low enough that the further panels 102 deform, to the extent necessary, under the force applied by the presence of the user's body within the garment 100 in order to accommodate the portion of the user's body within the garment 100.

The First and Second Materials

The first material 116 and the second material 120 are applied to the fabric panel 104 to affect the material properties of the fabric panel 104. In particular, the first and second materials 116, 120 are applied to the fabric panel 104 in a targeted manner to selectively adjust the compression of the garment 100, which further enhances and improves the wearer's athletic performance and experience. The compression of the garment 100 can be selectively adjusted not only by controlling the material properties of the first and second materials 116, 120, but also by controlling the pattern of application of the first and second materials 116, 120, the thickness of application of the first and second materials 116, 120, the density of application of the first and second materials 116, 120, and/or the amount of surface area covered by the application of the first and second materials 116, 120. By controlling each of these variables, the amounts and locations of compression imparted by the garment 100 are adaptable to maximize the effect on the wearer.

With respect to the material properties of the first and second materials 116, 120, the modulus of elasticity of each of the first and second materials 116, 120 is greater than the modulus of elasticity of the fabric panel 104. Accordingly, the modulus of elasticity of the fabric panel 104 is increased where either of the first and second materials 116, 120 is applied. Thus, the fabric panel 104 is more difficult to deform where either of the first and second materials 116, 120 is applied. By selectively applying the first and second materials 116, 120 to the fabric panel 104, the modulus of elasticity can be increased in particular locations on the garment 100 where additional support and structure are advantageous.

It is noted that even if the modulus of elasticity of the first and second materials 116, 120 are the same as that of the fabric panel 104, application of the first and second materials 116, 120 to the fabric panel 104 will still affect the thickness of the garment 100. Accordingly, it is not necessary that the first and second materials 116, 120 have a greater modulus of elasticity than the fabric panel 104 in order for their application to increase the modulus of elasticity of the garment 100 in locations where the first and second materials 116, 120 are applied.

In at least one embodiment, the first material 116 and the second material 120 are different materials. Accordingly, the first material 116 and the second material 120 affect the material properties of the fabric panel 104 differently. For example, areas of the fabric panel 104 to which the first material 116 is applied can have a different modulus of elasticity than areas of the fabric panel 104 to which the second material 120 is applied. Depending on the materials used, the modulus of elasticity of the fabric panel 104 in areas where the first material 116 is applied can be greater than or less than the modulus of elasticity of the fabric panel 104 in areas where the second material 120 is applied.

In at least one alternative embodiment, however, the first material 116 and the second material 120 can be the same material. In such an embodiment, the first material 116 and the second material 120 affect the material properties of the fabric panel 104 in the same way. For example, areas of the fabric panel 104 to which either of the first material 116 and the second material 120 is applied have the same modulus of elasticity.

In at least one embodiment, the first and second materials 116, 120 are formed of flexible, elastomeric polymers such as thermoplastic polyurethane or rubber (foamed or non-foamed). The first and second materials 116, 120 are applied to the textile of the fabric panel 104 such that any movement of the first and second materials 116, 120 generates movement in the fabric panel 104, and vice versa. By way of example, at least one of the first and second materials 116, 120 may be directly applied to the textile of the fabric panel 104 in a liquid or gelatinous state such that the polymer of the at least one of the first and second materials 116, 120 infiltrates the textile, flowing between the strands such that the polymer is embedded in the material. By way of example, the first and/or second materials 116, 120 may be applied via flow molding. By way of further example, the first and/or second materials 116, 120 may be applied via screen printing (e.g., three dimensional screen printing) or an additive manufacturing process (3D printing techniques). In other embodiments, the first and/or second materials 116, 120 may be applied in non-solid form and cured. In still other embodiments, the first and/or second materials 116, 120 are formed separately (e.g., via selective laser sintering/ablation) and subsequently adhered to the fabric panel 104 via, e.g., an adhesive, welding, etc.

In at least one exemplary embodiment, the second material 120 can be a silicone film or a silicone ink that is applied to the inwardly facing side 108 of the fabric panel 104. A greater coefficient of friction is present between a silicone ink and the user's skin than between the fabric of the fabric panel 104 and the user's skin. Thus, the silicone ink will move less freely, or will "stick" or "adhere" to the user's skin to retain the second material 120 in the desired locations on the user's body.

In the embodiment shown, the first and second materials 116, 120 are not applied to the further panels 102. In alternative embodiments, however, the first and second materials 116, 120 can additionally or alternatively be applied to the further panels 102 to affect the material properties of the further panels 102 in a targeted manner to selectively adjust the compression of the garment 100.

Application of the First and Second Materials in First and Second Patterns

With reference to FIGS. 1A and 1B, to selectively adjust the modulus of elasticity of the fabric panel 104, the first material 116 is applied to the outwardly facing side 112 of the fabric panel 104 in a first pattern 124, and the second material 120 is applied to the inwardly facing side 108 of the fabric panel 104 in a second pattern 128. The first material 116 is applied in the first pattern 124 to first regions 132 of the fabric panel 104, and the second material 120 is applied in the second pattern 128 to second regions 136 of the fabric panel 104. (In FIGS. 1A and 1B, the second pattern 128 and the second regions 136 are shown in phantom with dashed lines to indicate their arrangement on the inwardly facing side 108 of the fabric panel 104, which is not entirely visible in FIGS. 1A and 1B.)

As noted above, the pattern, thickness, surface area, and density of the application of the first and second materials 116, 120 each affect the modulus of elasticity of the garment 100. FIGS. 1A and 1B illustrate one exemplary embodiment of the first and second patterns 124, 128 and the first and second regions 132, 136. However, the first pattern 124 and the second pattern 128 can be applied in first and second regions 132, 136 having a variety of different shapes and positions on the fabric panel 104. Additionally, in the embodiment shown, the first regions 132 are different than the second regions 136 of the garment 100. However, in alternative embodiments, the first and second regions 132, 136 can be the same regions of the garment 100 or can overlap one another.

Repeated Units of the First and Second Patterns in First and Second Regions

Figure 2:
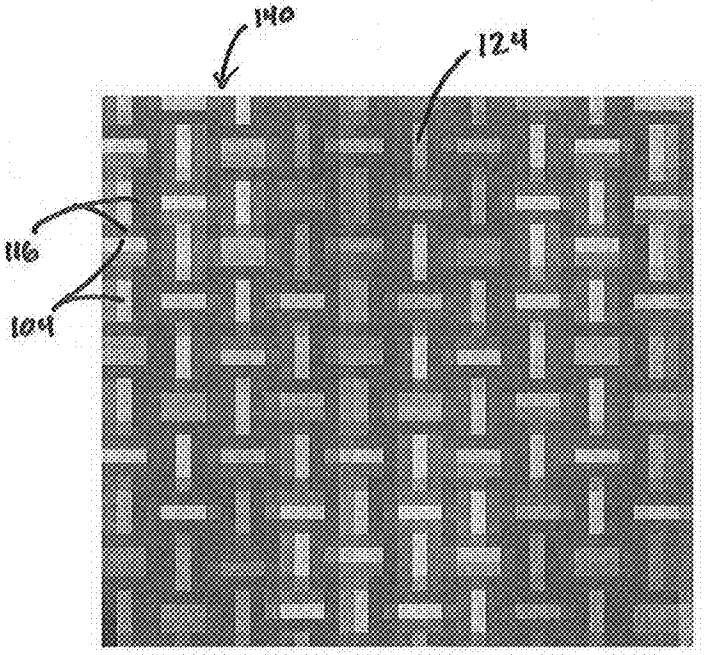
FIG. 2 is a depiction of a pattern formed by the first material.

FIG. 2 depicts a close up view of a first pattern 124. A unit of a pattern is a design or basic structural shape that is repeated or at least partially repeated to form the pattern. As shown in FIG. 2, the first material 116 is applied to the fabric panel 104 in a basket-weave pattern, the pattern resembling the structure of a basket or a woven fabric, with various units 140 repeated to form the first pattern 124. Depending on the shape of the first region 132 (shown in FIGS. 1A and 1B), the first material 116 is applied in one or more portions of the unit 140 that are repeated to fill or cover the first region 132. Accordingly, some unit(s) 140 of the first pattern 124 may be truncated or cut off at the boundaries of the first region 132. Although the first pattern 124 is shown in FIG. 2 as being a basket-weave pattern, it will be recognized that the first pattern 124 may be provided in any number of different forms such as a herringbone pattern, an auxetic pattern, a pattern of repeating circles, polygons, or other shapes, a tessellating pattern, or any of various other patterns, including those shown and described below with reference to FIGS. 5A-8.

Figure 3:
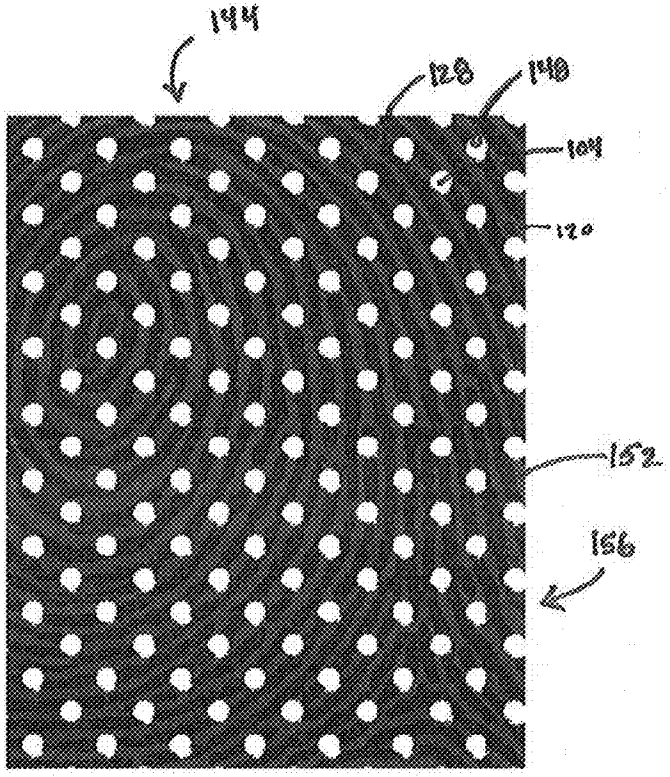
FIG. 3 is a depiction of a pattern formed by the second material.

FIG. 3 depicts a close up view of a second pattern 128. As shown in FIG. 3, the second material 120 is applied to the fabric panel 104 with a lattice pattern of holes 148 formed therein to form a unit 144 of the second pattern 128. More specifically, the holes 148 are formed in the second material 120 in equally spaced, staggered rows and columns to form a lattice. Depending on the shape of the second region 136 (shown in FIGS. 1A and 1B), the second material 120 is applied in one or more portions of the unit 144 that are repeated to fill or cover the second region 136. Accordingly, some unit(s) 144 of the second pattern 128 may be truncated or cut off at the boundaries of the second region 136. In the embodiment shown, the first pattern 124 is different from the second pattern 128. However, in alternative embodiments, the first pattern 124 can be the same as the second pattern 128. Additionally, although the second pattern 128 is shown in FIG. 3 as having a lattice pattern of holes, it will be recognized that the second pattern 128 may be provided in any number of different forms such as a herringbone pattern, an auxetic pattern, a pattern of repeating circles, polygons, or other shapes, a tessellating pattern, or any of various other patterns, including those shown and described below with reference to FIGS. 5A-8.

In the embodiment shown, the garment 100 also includes a further pattern 152, as shown in FIG. 3. As shown in FIG. 3, the further pattern 152 is a pattern of swirled lines resembling the structure of a fingerprint. The further pattern 152 is different from the second pattern 128, and is superimposed onto the second pattern 128. Accordingly, the further pattern 152 is also applied to the second regions 136. The further pattern 152 can be formed of the first material 116, the second material 120, or a further material. Like the second pattern 128, the further pattern 152 is also applied in a unit 156, one or more portions of which is repeated to fill or cover the second region 136. Accordingly, the unit(s) 156 of the further pattern 152 may be truncated or cut off at a boundaries of the second region 136. In alternative embodiments, the further pattern 152 may additionally or alternatively be superimposed onto the first pattern 124 and applied to the first regions 132 of the garment 100. In further alternative embodiments, the further pattern 152 can be applied in further regions (not shown), which may or may not overlap the first and/or second regions 132, 136 of the garment 100.

The First and Second Regions

Figures 4A, 4B, 4C:
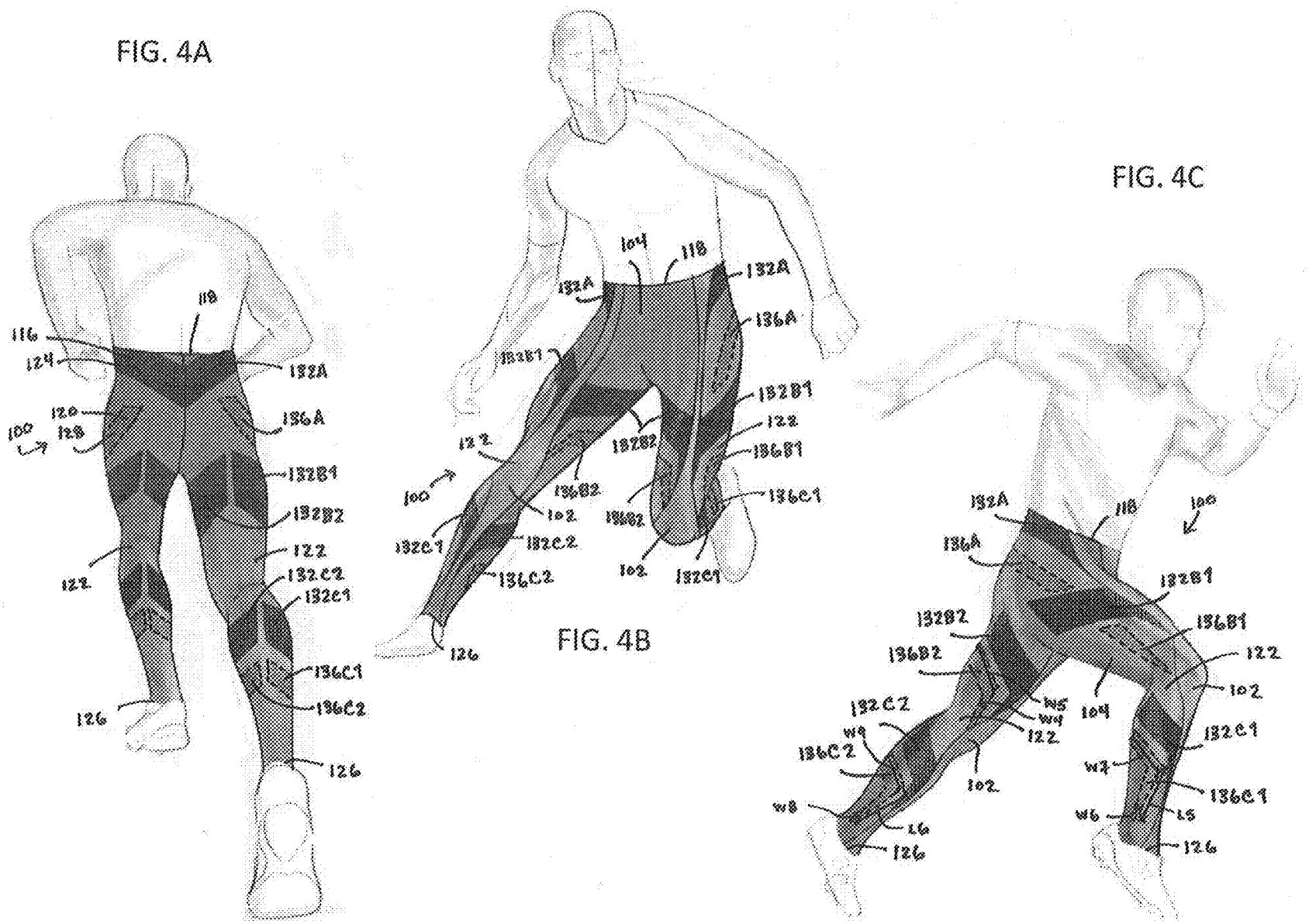
FIG. 4A is a rear perspective view of the garment of FIGS. 1A and 1B in use on a wearer.
FIG. 4B is a front perspective view of the garment of FIGS. 1A and 1B in use on a wearer.
FIG. 4C is a side view of the garment of FIGS. 1A and 1B in use on a wearer.
Figures 5A, 5B, 5C, 5D:
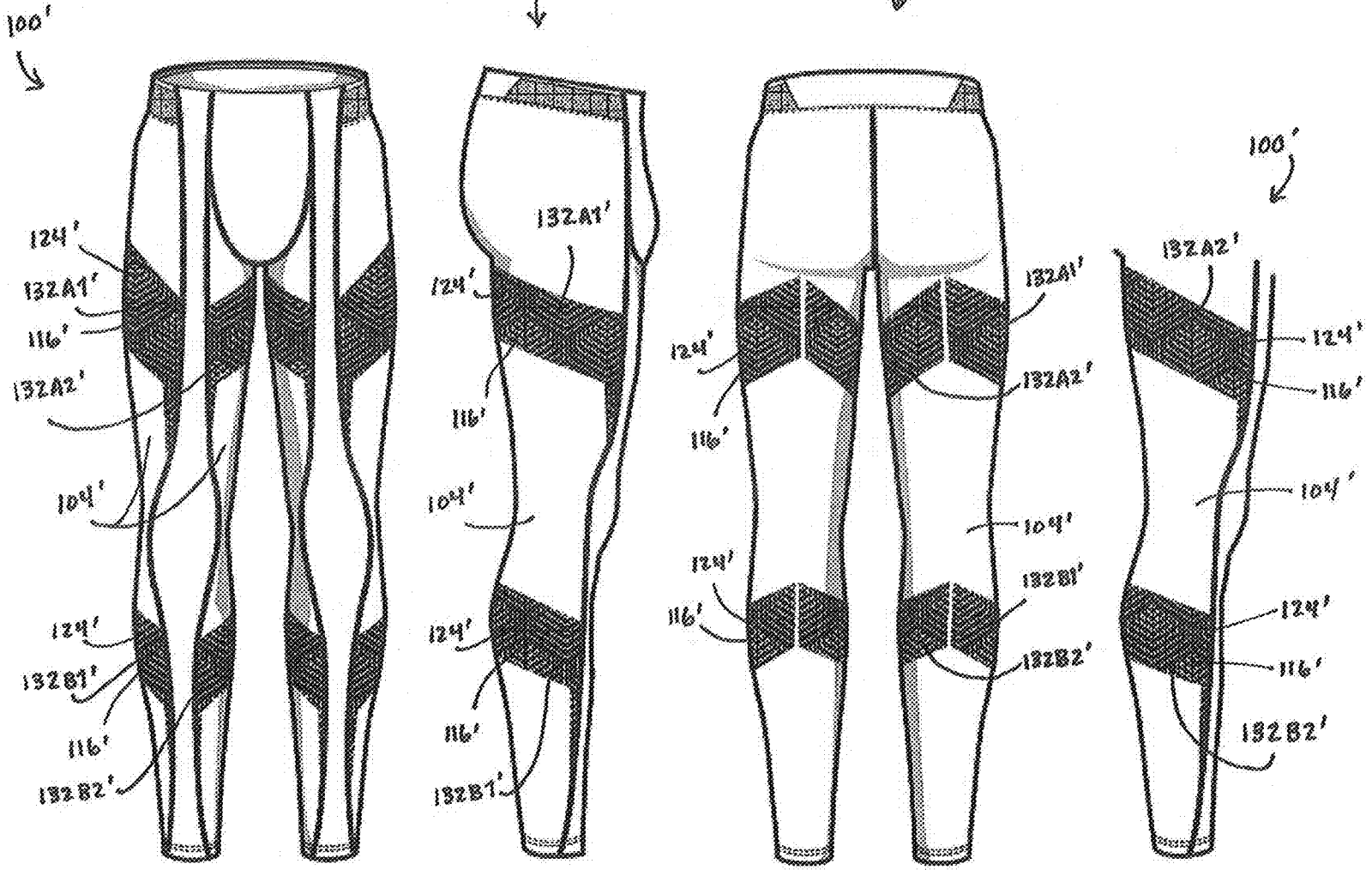
FIG. 5A is a front view of an outwardly facing surface of alternative embodiment of the garment of FIGS. 1A and 1B including an alternative embodiment of the fabric panel and the first and second materials.
FIG. 5B is a left side view of the outwardly facing surface of the garment of FIG. 5A.
FIG. 5C is a rear view of the outwardly facing surface of the garment of FIG. 5A.
FIG. 5D is an inseam view, which is a left side view taken from a midline of the garment, of the outwardly facing surface of the garment of FIG. 5A.

FIGS. 4A-4C show the garment 100 as it is worn on the portion of the user's body. As described in more detail below, the first pattern 124 and the second pattern 128 (the second pattern 128 shown in phantom with dashed lines to indicate its arrangement on the inwardly facing side 108 of the fabric panel 104, which is not visible in FIGS. 4A-4C) are applied to the fabric panel 104 in an arrangement of first and second regions 132, 136 that corresponds to skeletal muscles and connective tissues in the portion of the user's body. In the embodiment shown, the first regions 132 do not overlap the second regions 136. However, in alternative embodiments, the first regions 132 can overlap the second regions 136 partially or entirely. Furthermore, in alternative embodiments, some or all of the first regions 132 can partially or entirely overlap some or all of the second regions 136.

The application of the first pattern 124 in the first regions 132 increases the modulus of elasticity of the fabric panel 104 in these particular areas. Accordingly, the first material 116 in the first pattern 124 applies more force to the user's body in these areas, thereby aligning and supporting the wearer's musculature and connective tissues. Additionally, the first material 116 in the first pattern 124 acts as a muscle dampener, to reduce muscle vibrations in these areas. Reducing muscle vibrations is associated with improving muscle efficiency and reducing muscle fatigue. Thus, the first pattern 124 in the first regions 132 enhances and improves the wearer's athletic performance and experience.

Similarly, the application of the second pattern 128 in the second regions 136 increases the modulus of elasticity of the fabric panel 104 in these particular areas. Accordingly, the second material 120 in the second pattern 128 applies more force to the user's body in these areas, thereby aligning and supporting the wearer's musculature and connective tissues. Additionally, the second material 120 in the second pattern 128 acts as an elastic therapeutic tape, by slightly lifting the user's skin in these areas. Slightly lifting the user's skin is associated with improving the neuromuscular feedback that inhibits or facilitates firing of muscle fibers, facilitating lymphatic drainage, reducing inflammation, and improving blood flow. Thus, the second pattern 128 in the second regions 136 enhances and improves the wearer's athletic performance and experience.

The First Regions

In particular, as shown in FIGS. 4A-4C, the first pattern 124 of the first material 116 is applied to the outwardly facing side 112 of the fabric panel 104 in: an upper first region 132A, which corresponds to the musculature and connective tissues associated with the wearer's lower back and upper hips; middle first regions 132B1 and 132B2, which correspond to the musculature and connective tissues associated with the wearer's thighs; and lower first regions 134C1 and 134C2, which correspond to the musculature and connective tissues associated with the wearer's lower leg.

The Upper First Region

As shown more clearly in FIGS. 1A and 1B, the upper first region 132A extends from a lateral seam 106A, which is formed along the lateral boundary of one of the further panels 102, around the fabric panel 104, to the lateral seam 106A that is formed along the lateral boundary of the other of the further panels 102. The upper first region 132A does not, however, extend into either of the further panels 102. The upper first region 132A also extends along both of the lateral seams 106A for a distance D1 that is between approximately 4 inches and approximately 8 inches. The upper first region 132A forms a "v" shape, between the lateral seams 106A. In particular, the upper first region 132A extends along a portion of the waistband 118 near the lateral seams 106A, angles downwardly and away from each of the lateral seams 106A and the waistband 118, and forms a point 134 at the midline 101 of the garment 100 that is approximately equidistant from both of the lateral seams 106A. At the point 134, the upper first region 132A extends along the midline 101 for a distance of D2 that is shorter than the distance D1. The distance D2 can be, for example, between approximately 3 inches and approximately 5 inches.

As noted above, the upper first region 132A corresponds to the musculature and connective tissues associated with the wearer's lower back and upper hips. Thus, the application of the first material 116 in the first pattern 124 in the upper first region 132A aligns and supports the musculature and connective tissues of the wearer's lower back and upper hips. Additionally, the application of the first material 116 in the first pattern 124 in the upper first region 132A acts as a muscle dampener, to reduce muscle vibrations in the lower back and upper hips to improve muscle efficiency and reduce muscle fatigue.

The Middle First Regions

Each of the leg portions 122 of the garment 100 includes middle first regions 132B1 and 132B2, which are configured to extend around each of the upper legs of the user. The middle first regions 132B1, 132B2 on each of the leg portions 122 are substantially identical and are mirrored over the midline 101 of the garment 100. The middle first regions 132B1, 132B2 are positioned nearer to the leg openings 126 than is the upper first region 132A. The middle first regions 132B1, 132B2 include a lateral middle first region 132B1, which extends from a lateral seam 106A to a lateral edge 160A of a gap 164 (shown in FIG. 1B), and a medial middle first region 132B2, which extends from a medial edge 160B of the gap 164 to a medial seam 106B. The gap 164 has a width W1 that is, for example, between approximately 0.25 inches and approximately 1.5 inches.

The lateral middle first region 132B1 is arranged on the lateral portion of the user's upper leg, which is the portion farthest from and/or facing away from the midline of the user's body and from the midline 101 of the garment 100. Conversely, the medial middle first region 132B2 is arranged on the medial portion of the user's upper leg, which is the portion nearest to and/or or facing toward the midline of the user's body and the midline 101 of the garment 100.

The lateral middle first region 132B1 extends a distance D3 along the lateral seam 106B and a distance D4 along the lateral edge 160A of the gap 164. The distance D3 is larger than the distance D4. For example, the distance D3 can be between approximately 5 inches and approximately 7 inches, and the distance D4 can be between approximately 4 inches and approximately 5 inches. Similarly, the medial middle first region 132B2 extends a distance D5 along the medial seam 106B and a distance D6 along the medial edge 160B of the gap 164. The distance D5 is larger than the distance D6. For example, the distance D5 can be between approximately 5 inches and approximately 7 inches, and the distance D6 can be between approximately 4 inches and approximately 5 inches.

Each of the lateral and medial middle first regions 132B1, 132B2 extends upwardly and away from the respective seam 106A, 106B and toward the waistband 118. Thus, the lateral and medial middle first regions 132B1, 132B2 are nearer to the waistband 118 at the edges 160A, 160B of the gap 164 and are farther from the waistband 118 at the seams 106A, 106B.

The medial middle first region 132B2 corresponds to the musculature and connective tissues associated with the wearer's groin, medial hamstring, and medial thigh. Thus, the application of the first material 116 in the first pattern 124 in the medial middle first region 132B2 aligns and supports the musculature and connective tissues of the wearer's groin, hamstring, and thigh. Additionally, the application of the first material 116 in the first pattern 124 in the medial middle first region 132B2 acts as a muscle dampener, to reduce muscle vibrations in the groin, hamstring, and thigh to improve muscle efficiency and reduce muscle fatigue.

Similarly, the lateral middle first region 132B1 corresponds to the musculature and connective tissues associated with the wearer's lateral hamstring and thigh. Thus, the application of the first material 116 in the first pattern 124 in the lateral middle first region 132B1 aligns and supports the musculature and connective tissues of the wearer's hamstring and thigh. Additionally, the application of the first material 116 in the first pattern 124 in the lateral middle first region 132B1 acts as a muscle dampener, to reduce muscle vibrations in the hamstring and thigh to improve muscle efficiency and reduce muscle fatigue.

The middle first regions 132B1, 132B2 do not extend into the further panel 102 or into the gap 164. Because the gap 164 and the further panel 102 are free from the application of the first material 116, the gap 164 and the further panel 102 have a lower modulus of elasticity than the adjacent middle first regions 132B1, 132B2. Thus, these areas, arranged generally along the user's hamstring and quadriceps muscles, are more flexible and are more easily stretched to accommodate the user's body during movement. In other words, these areas prevent the middle first regions 132B1, 132B2 from having a greater modulus of elasticity extending entirely around the user's upper legs, and into areas which would undesirably restrict and inhibit movement.

The Lower First Regions

Each of the leg portions 122 of the garment 100 also includes lower first regions 132C1 and 132C2, which are configured to extend around each of the lower legs of the user. The lower first regions 132C1, 132C2 on each of the leg portions 122 are substantially identical and are mirrored over the midline 101 of the garment 100. The lower first regions 132C1, 132C2 are positioned nearer to the leg openings 126 than are the middle first regions 132B1, 132B2. The lower first regions 132C1, 132C2 include a lateral lower first region 132C1, which extends from a lateral seam 106A to a lateral edge 168A of a lower gap 172 (shown in FIG. 1B), and a medial lower first region 132C2, which extends from a medial edge 168B of the lower gap 172 to a medial seam 106B. The lower gap 172 has a width W2 that is, for example, between approximately 0.25 inches and approximately 1.5 inches.

The medial lower first region 132C2 is arranged on the medial portion of the user's lower leg, which is the portion nearest to and/or facing toward the midline of the user's body and the midline 101 of the garment 100. Conversely, the lateral lower first region 132C1 is arranged on the lateral portion of the user's lower leg, which is the portion farthest from and/or facing away from the midline of the user's body and from the midline 101 of the garment 100. The lateral lower first region 132C1 extends a distance D7 along the lateral seam 106B and a distance D8 along the lateral edge 168A of the lower gap 172. The distance D7 is larger than the distance D8. For example, the distance D7 can be between approximately 5 inches and approximately 7 inches, and the distance D8 can be between approximately 3 inches and approximately 5 inches. Similarly, the medial lower first region 132C2 extends a distance D9 along the medial seam 106B and a distance D10 along the medial edge 168B of the lower gap 172. The distance D9 is larger than the distance D10. For example, the distance D9 can be between approximately 5 inches and approximately 7 inches, and the distance D10 can be between approximately 3 inches and approximately 5 inches.

Each of the lateral and medial lower first regions 132C1, 132C2 extends upwardly and away from the respective seam 106A, 106B and toward the waistband 118. Thus, the lateral and medial lower first regions 132C1, 132C2 are nearer to the waistband 118 at the lower gap 172 and are farther from the waistband 118 at the seams 106A, 106B.

The medial lower first region 132C2 corresponds to the musculature and connective tissues associated with the wearer's medial shin and medial calf. Thus, the application of the first material 116 in the first pattern 124 in the medial lower first region 132C2 aligns and supports the musculature and connective tissues of the wearer's shin and calf. Additionally, the application of the first material 116 in the first pattern 124 in the medial lower first region 132C2 acts as a muscle dampener, to reduce muscle vibrations in the shin and calf to improve muscle efficiency and reduce muscle fatigue.

Similarly, the lateral lower first region 132C1 corresponds to the musculature and connective tissues associated with the wearer's lateral shin and calf. Thus, the application of the first material 116 in the first pattern 124 in the lateral lower first region 132C1 aligns and supports the musculature and connective tissues of the wearer's shin and calf. Additionally, the application of the first material 116 in the first pattern 124 in the lateral lower first region 132C1 acts as a muscle dampener, to reduce muscle vibrations in the shin and calf to improve muscle efficiency and reduce muscle fatigue.

The lower first regions 132C1, 132C2 do not extend into the further panel 102 or into the lower gap 172. Because the lower gap 172 and the further panel 102 are free from the application of the first material 116, the lower gap 172 and the further panel 102 have a lower modulus of elasticity than the adjacent lower first regions 132C1, 132C2. Thus, these areas, arranged generally along the user's shin and calf, are more flexible and are more easily stretched to accommodate the user's body during movement. In other words, these areas prevent the lower first regions 132C1, 132C2 from having a greater modulus of elasticity extending entirely around the user's lower legs, which would undesirably restrict and inhibit movement.

The Second Regions

Also shown in FIGS. 4A-4C, the second pattern 128 of the second material 120 is applied to the inwardly facing side 108 of the fabric panel 104 in: an upper second region 136A, which corresponds to the musculature and connective tissues associated with the wearer's gluteal muscles and upper iliotibial band; middle second regions 136B1 and 136B2, which correspond to the musculature and connective tissues associated with the wearer's groin and lower iliotibial band; and lower second regions 136C1 and 136C2, which correspond to the musculature and connective tissues associated with the wearer's lower legs and ankles. Each of the leg portions 122 of the garment 100 includes an upper second region 136A, a lateral middle second region 136B1, a medial middle second region 136B2, a lateral lower second region 136C1, and a medial lower second region 136C2. These regions on each of the leg portions 122 are substantially identical and are mirrored over the midline 101 of the garment 100.

The Upper Second Region

As shown more clearly in FIGS. 1A and 1B, the upper second region 136A extends upwardly and away from a position near a lateral seam 106A, around the fabric panel 104, in a direction toward the upper first region 132A and the midline 101 of the garment 100. The upper second region 136A does not extend into the further panel 102 or into a first region 132. The upper second region 136A is generally shaped as a quadrilateral having a width W3 that is, for example, between approximately 1 inch and approximately 3 inches, and having a length L1 that is, for example, between approximately 5 inches and approximately 8 inches. Because the length L1 wraps around the lateral side of the garment 100, the entirety of the length L1 is not visible in either of FIG. 1A or 1B, but is partially visible in each of FIGS. 1A and 1B.

As noted above, the upper second region 136A corresponds to the musculature and connective tissues associated with the wearer's gluteal muscles and upper iliotibial band. Thus, the application of the second material 120 in the second pattern 128 in the upper second region 136A aligns and supports the musculature and connective tissues of the wearer's gluteal muscles and upper iliotibial band. Additionally, the application of the second material 120 in the second pattern 128 in the upper second region 136A acts as an elastic therapeutic tape, to slightly lift the user's skin around the gluteal muscles and upper iliotibial band to facilitate firing of muscle fibers, facilitate lymphatic drainage, reduce inflammation, and improve blood flow.

The Middle Second Regions

Each of the leg portions 122 of the garment 100 includes middle second regions 136B1 and 136B2, which are configured to extend around each of the upper legs of the user. The lateral middle second region 136B1 is arranged on the lateral portion of the user's upper leg. Conversely, the medial middle second region 136B2 is arranged on the medial portion of the user's upper leg. The middle second regions 136B1, 136B2 are positioned nearer to the leg openings 126 than is the upper second region 136A.

The lateral middle second region 136B1 extends upwardly and away from a position near a lateral seam 106A in a direction toward the lateral middle first region 132B1. The lateral middle second region 136B1 does not, however, extend into the further panel 102 or into the lateral middle first region 132B1. The lateral middle second region 136B1 is generally shaped as a triangle that tapers outwardly as it extends upwardly and away from the position near the lateral seam 106A. In other words, the width of the lateral middle second region 136B1 varies along a length L2 of the lateral middle second region 136B1. The length L2 of the lateral middle second region 136B1 can be, for example, between approximately 4 inches and approximately 7 inches.

The lateral middle second region 136B1 corresponds to the musculature and connective tissues associated with the wearer's lower iliotibial band. Thus, the application of the second material 120 in the second pattern 128 in the lateral middle second region 136B1 aligns and supports the musculature and connective tissues of the wearer's lower iliotibial band. Additionally, the application of the second material 120 in the second pattern 128 in the lateral middle second region 136B1 acts as an elastic therapeutic tape, to slightly lift the user's skin around the lower iliotibial band to facilitate firing of muscle fibers, facilitate lymphatic drainage, reduce inflammation, and improve blood flow.

The medial middle second region 136B2 extends upwardly and away from a medial seam 106B, around a medial side of the upper leg, and toward the midline 101 of the garment 100. The medial middle second region 136B2 extends along the medial seam 106B for a length L3 that is, for example, between approximately 0.25 inches and approximately 2 inches. As the medial middle second region 136B2 extends upwardly and away from the medial seam 106B, the medial middle second region 136B2 extends in a direction that is substantially parallel to the length L2 of the lateral middle second region 136B1 for a length L4 that is, for example, between approximately 2 inches and approximately 5 inches. The width of the medial middle second region 136B2 varies along the length L4. Nearer to the medial seam 106B, the medial middle second region 136B2 can have a first width W4 of, for example, between approximately 0.25 inches and approximately 2 inches. Farther from the medial seam 106B, the medial middle second region 136B2 can have a second width W5 of, for example, between approximately 4 and approximately 8 inches. The variation between the first width W4 and the second width W5 of the medial middle second region 136B2 can be seen most clearly in FIG. 4C.

The medial middle second region 136B2 corresponds to the musculature and connective tissues associated with the wearer's groin and medial hamstring. Thus, the application of the second material 120 in the second pattern 128 in the medial middle second region 136B2 aligns and supports the musculature and connective tissues of the wearer's groin and hamstring. Additionally, the application of the second material 120 in the second pattern 128 in the medial middle second region 136B2 acts as an elastic therapeutic tape, to slightly lift the user's skin around the groin and hamstring to facilitate firing of muscle fibers, facilitate lymphatic drainage, reduce inflammation, and improve blood flow.

The middle second regions 136B1, 136B2 do not extend into the further panel 102. Because the further panel 102 is free from the application of the second material 120, the further panel 102 has a lower modulus of elasticity than the adjacent middle second regions 136B1, 136B2. Thus, these areas, arranged generally along the user's iliotibial band, groin, and hamstring, are more flexible and are more easily stretched to accommodate the user's body during movement. In other words, these areas prevent the middle second regions 136B1, 136B2 from having a greater modulus of elasticity in areas which would undesirably restrict and inhibit movement.

The Lower Second Regions

Each of the leg portions 122 of the garment 100 includes lower second regions 136C1 and 136C2, which are configured to extend around each of the lower legs of the user. The lateral lower second region 136C1 is arranged on the lateral portion of the user's lower leg. Conversely, the medial lower second region 136C2 is arranged on the medial portion of the user's lower leg. The lower second regions 136C1, 136C2 are positioned nearer to the leg openings 126 than are the middle second regions 136B1, 136B2.

The lateral lower second region 136C1 is only partially visible in FIGS. 1B and 1*s* shown more clearly in FIG. 4C. The lateral lower second region 136C1 extends upwardly and away from a position near the leg opening 126 and the lateral seam 106A, around a lateral side of the lower leg, and in a direction toward the lateral lower first region 132C1. The lateral lower second region 136C1 does not, however, extend into the further panel 102 or into the lateral lower first region 132C1.

The lateral lower second region 136C1 extends in a direction that is substantially parallel to the midline 101 of the garment for a length L5 that is, for example, between approximately 4 inches and approximately 7 inches. The width of the lateral lower second region 136C1 varies along the length L5. Nearer to the leg opening 126, the lateral lower second region 136C1 can have a first width W6 of, for example, between approximately 0.25 inches and approximately 2 inches. Farther from the leg opening 126, the lateral lower second region 136C1 can have a second width W7 of, for example, between approximately 3 and approximately 6 inches. Because the lateral lower second region 136C1 wraps around the lateral lower leg of the garment 100, only a portion of the second width W7 is visible in FIG. 1B. The variation between the first width W6 and the second width W7 of the lateral lower second region 136C1 can be seen most clearly in FIG. 4C.

Similarly, the medial lower second region 136C2 is only partially visible in FIGS. 1B and 1*s* shown more clearly in FIG. 4C. The medial lower second region 136C2 extends upwardly and away from a position near the leg opening 126 and the medial seam 106B, around a medial side of the lower leg, and in a direction toward the medial lower first region 132C2. The medial lower second region 136C2 does not, however, extend into the further panel 102 or into the medial lower first region 132C2.

Like the lateral lower second region 132C1, the medial lower second region 136C2 extends in a direction that is substantially parallel to the midline 101 of the garment for a length L6 that is, for example, between approximately 4 inches and approximately 7 inches. The width of the medial lower second region 136C2 varies along the length L6. Nearer to the leg opening 126, the medial lower second region 136C2 can have a first width W8 of, for example, between approximately 0.25 inches and approximately 2 inches. Farther from the leg opening 126, the medial lower second region 136C2 can have a second width W9 of, for example, between approximately 3 and approximately 6 inches. Because the medial lower second region 136C2 wraps around the medial lower leg of the garment 100, only a portion of the second width W9 is visible in FIG. 1B. The variation between the first width W8 and the second width W9 of the medial lower second region 136C2 can be seen most clearly in FIG. 4C.

The lateral and medial lower second regions 136C1, 136C2 correspond to the musculature and connective tissues associated with the wearer's ankle and calf. Thus, the application of the second material 120 in the second pattern 128 in the lateral and medial lower second regions 136C1, 136C2 aligns and supports the musculature and connective tissues of the wearer's ankle and calf. Additionally, the application of the second material 120 in the second pattern 128 in the lateral and medial lower second regions 136C1, 136C2 acts as an elastic therapeutic tape, to slightly lift the user's skin around the ankle and calf to facilitate firing of muscle fibers, facilitate lymphatic drainage, reduce inflammation, and improve blood flow.

The lower second regions 136C1, 136C2 do not extend into the further panel 102 or into a further gap 176 formed between the second width W7 of the lateral lower second region 136C1 and the second width W9 of the medial lower second region 136C2. The further gap 176 is generally aligned with the gap 164 between the middle first regions 132B1, 132B2 and the lower gap 172 between the lower first regions 132C1, 132C2. Because the further panel 102 and the further gap 176 are free from the application of the second material 120, the further panel 102 and the further gap 176 have a lower modulus of elasticity than the adjacent lower second regions 136C1, 136C2. Thus, these areas, arranged generally along the user's ankle and calf, are more flexible and are more easily stretched to accommodate the user's body during movement. In other words, these areas prevent the lower second regions 136C1, 136C2 from having a greater modulus of elasticity in areas which would undesirably restrict and inhibit movement.

An Alternative Embodiment

FIGS. 5A-5D and 6A-6D show an alternative exemplary embodiment of the garment 100'. The garment 100' is substantially similar in structure and function to the garment 100. The garment 100' differs from the garment 100, however, in the particular application of the first material 116' (shown in FIGS. 5A-5D) and second material 120' (shown in FIGS. 6A-6D) to the fabric panel 104'. More specifically, the first pattern 124' (shown in FIGS. 5A-5D) is different from the first pattern 124, and the first pattern 124' is applied to different first regions 132' than the first regions 132. Similarly, the second pattern 128' (shown in FIGS. 6A-6D) is different from the second pattern 128, and the second pattern 128' is applied to different second regions 136' than the second regions 136. Accordingly, the amounts and locations of compression applied by the garment 100' are different than the amounts and locations of compression applied by the garment 100.

The First Pattern

Figure 7:
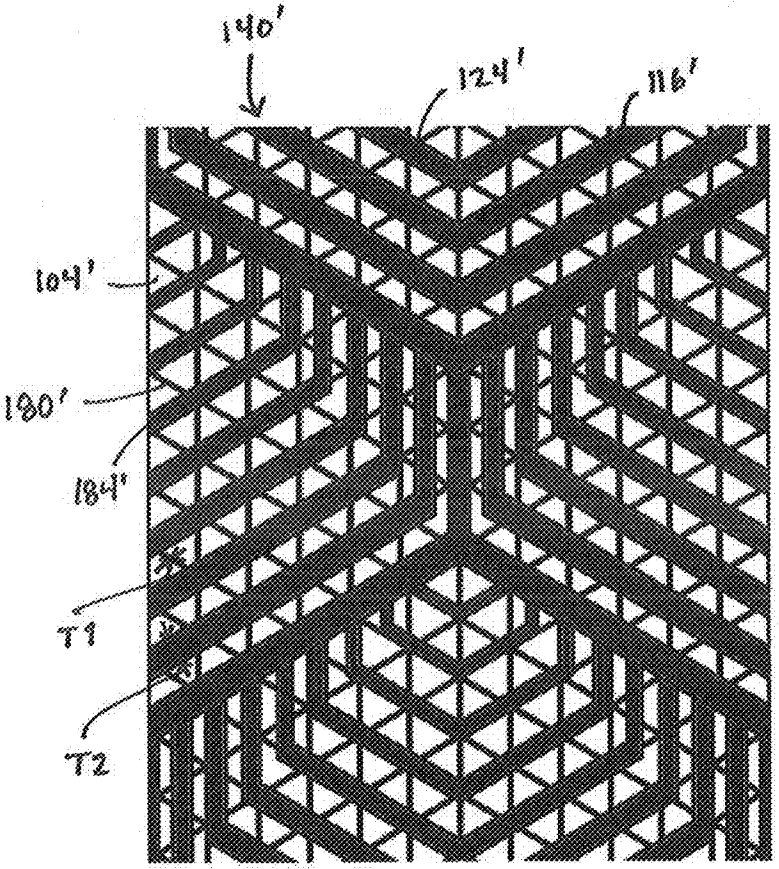
FIG. 7 is a depiction of a unit of a pattern formed by the first material of the garment of FIG. 5A.

FIG. 7 depicts a unit 140' of the first pattern 124' of the first material 116'. In the unit 140', the first material 116' is applied as a repeating geometric pattern. More specifically, the first material 116' is applied to the fabric panel 104' in first areas 180' generally forming a tessellation of equilateral triangles. The first material 116' is also applied in second areas 184' superimposed on the first areas 180'. Some of the first areas 180' are coincident with some of the second areas 184'. A thickness T1 of the first material 116' applied in the first areas 180' is consistent. A thickness T2 of the first material 116' applied in the second areas 184' is thicker than the thickness T1, but varies over the unit 140'. The second areas 184' form portions of hexagons such that when the unit 140' is repeated, the second areas 184' of adjacent units 140' form tessellating hexagons.

The Second Pattern

Figure 8:
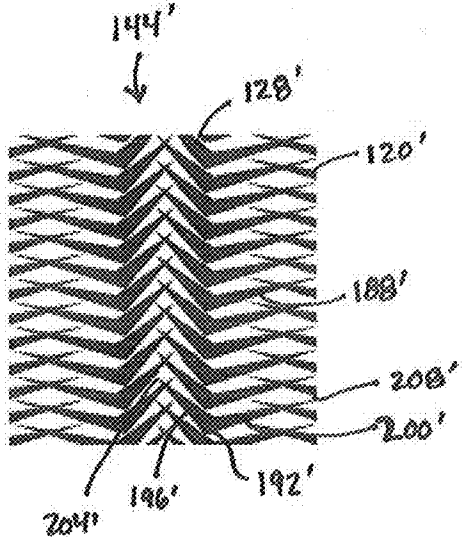
FIG. 8 is a depiction of a pattern formed by the second material of the garment of FIG. 6A.

FIG. 8 depicts various units 144' of the second pattern 128' of the second material 120'. In the unit 144', the second material 120' is applied as a repeating geometric pattern. More specifically, the second material 120' is applied in a plurality of polygonal bodies 188', which are arranged to overlap one another. Each polygonal body 188' includes a vertex 192', a short arm 196' extending in a first direction from the vertex 192', and a long arm 200' extending in a second direction from the vertex 192'. Each of the short arm 196' and the long arm 200' of each of the polygonal bodies 188' tapers as it extends away from the vertex 192'. Thus, each of the short arm 196' and the long arm 200' extends from the vertex 192' to a respective point 204', 208'.

The polygonal bodies 188' are arranged in columns within the pattern 128' such that the vertex 192' of each of the polygonal bodies 188' is adjacent to a vertex 192' of two adjacent polygonal bodies 188' in the same column. Additionally, the polygonal bodies 188' are arranged in rows within the pattern 128' and alternate in opposite directions within the row such that the short arms 196' of adjacent polygonal bodies 188' overlap one another near the points 204' and the long arms 200' of adjacent polygonal bodies 188' overlap one another 200' near the points 208'. Each of the short arms 196' only overlaps the adjacent short arm 196' of one adjacent polygonal body 188' in the same row, and each of the long arms 200' only overlaps the adjacent long arm 200' of one adjacent polygonal body 188' in the same row.

The First Regions

As shown in FIGS. 5A-5D, the first pattern 124' is applied in: lateral upper first regions 132A1', which correspond to the musculature and connective tissues associated with each of the wearer's outer upper legs; medial upper first regions 132A2', which correspond to the musculature and connective tissues associated with each of the wearer's inner upper legs; lateral lower first regions 132B1', which correspond to the musculature and connective tissues associated with each of the wearer's lateral lower legs; and medial lower first regions 132B2', which correspond to the musculature and connective tissues associated with each of the wearer's medial lower legs.

The lateral and medial upper first regions 132A1', 132A2' are substantially similar to the lateral and medial middle first regions 132B1, 132B2 described above and shown in FIGS. 1A and 1B. The lateral and medial lower first regions 132B1', 132B2' are substantially similar to the lateral and medial lower first regions 132C1, 132C2 described above and shown in FIGS. 1A and 1B.

The application of the first pattern 124' in these first regions 132' increases the modulus of elasticity of the fabric panel 104' in these particular areas. Accordingly, the first pattern 124' applies more force to the user's body in these areas, thereby aligning and supporting the wearer's musculature and connective tissues, and dampening muscle vibrations, to enhance and improve the wearer's athletic performance and experience.

The Second Regions

As shown in FIGS. 6A-6D, the second pattern 128' is applied in: upper second regions 136A', which correspond to the musculature and connective tissues associated with each of the wearer's gluteal muscles; lateral middle second regions 136B1', which correspond to the musculature and connective tissues associated with each of the wearer's iliotibial bands and knees; medial middle second regions 136B2', which correspond to the musculature and connective tissues associated with each of the wearer's groin, inner thighs and knees; lateral lower second regions 136C1', which correspond to the musculature and connective tissues associated with each of the wearer's outer lower legs and ankles; and medial lower second regions 136C2', which correspond to the musculature and connective tissues associated with each of the wearer's inner lower legs and ankles.

The Upper Second Region

The upper second region 136A' is substantially similar to the upper second region 136A described above and shown in FIGS. 1A and 1B.

The Middle Second Regions

Figures 6A, 6B, 6C, 6D:
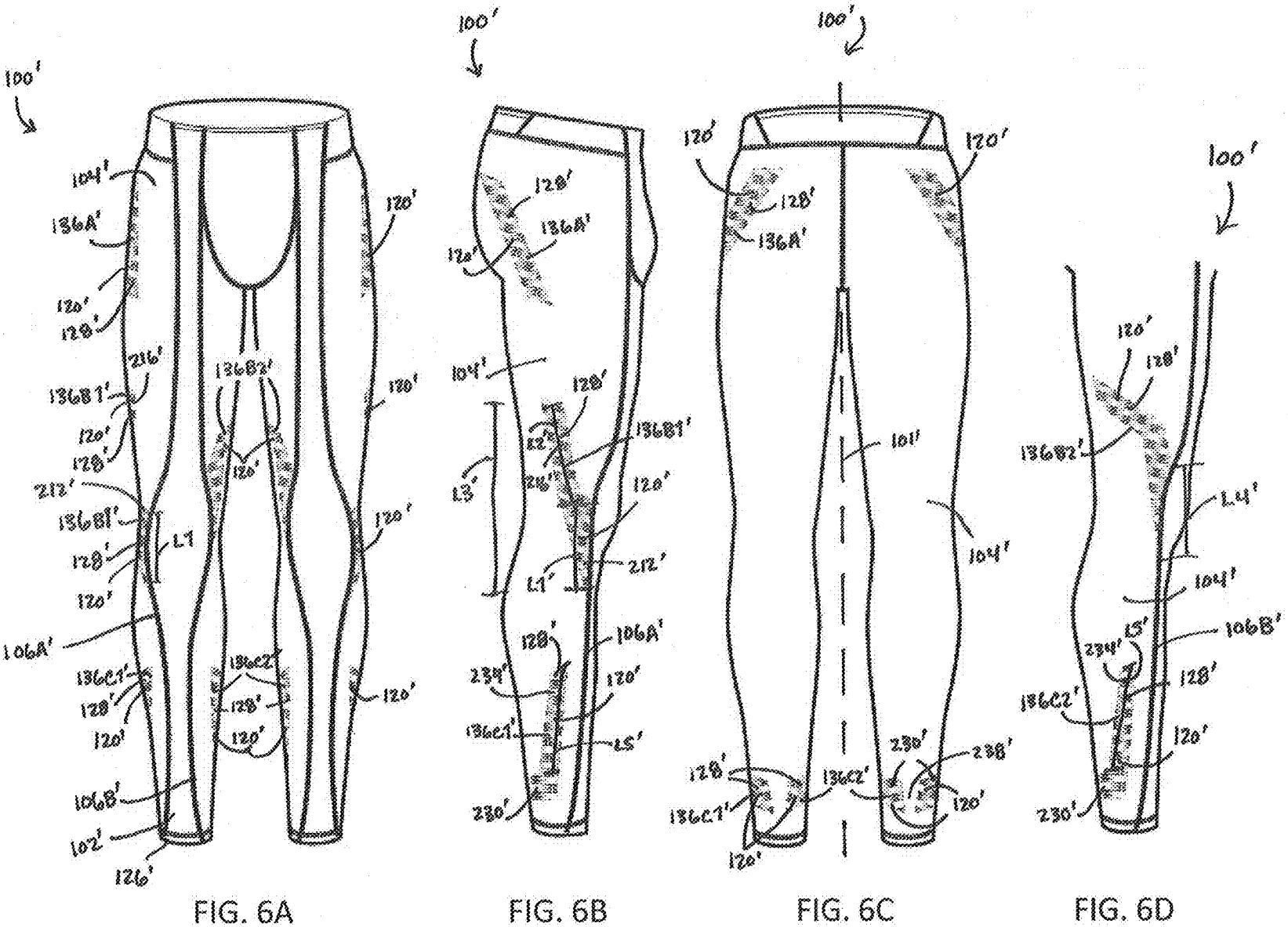
FIG. 6A is a front view of an inwardly facing surface of the alternative embodiment of the garment of FIG. 5A.
FIG. 6B is a left side view of the inwardly facing surface of the garment of FIG. 6A.
FIG. 6C is a rear view of the inwardly facing surface of the garment of FIG. 6A.
FIG. 6D is an inseam view, which is a left side view taken from a midline of the garment, of the inwardly facing surface of the garment of FIG. 6A.

The lateral middle second region 136B1' is somewhat similar to the lateral middle second region 136B1 described above and shown in FIGS. 1A, 1B, and 4C. As shown in FIG. 6B, the lateral middle second region 136B1' differs from the lateral middle second region 136B1 because the lateral middle second region 136B1' includes a first portion 212' and a second portion 216'. The first portion 212' extends along the lateral seam 106A' for a length L1' that is between approximately 3 inches and approximately 5 inches. As the first portion 212' extends upwardly along the lateral seam 106A', away from the leg opening 126', the first portion 212' also extends upwardly and away from the lateral seam 106A'. Thus, the first portion 212' widens as it extends upwardly along the length L1'.

The second portion 216' of the lateral middle second region 136B1' extends from the uppermost end of the first portion 212' and does not extend along the lateral seam 106A', but is separated from the lateral seam 106A' by an intervening portion of the fabric panel 104. The second portion 216' extends further upwardly away from the leg opening 126' and the lateral seam 106A' than does the first portion 212', but does not taper. The second portion 216' is generally trapezoidal in shape and has a length L2' extending from the length L1' of the first portion 212'. The length L2' is, for example, between approximately 3 inches and approximately 5 inches. The total length L3' of the lateral middle second region 136B1' is the summation of the first length L1' and the second length L2'. Thus, the length L3' is, for example, between approximately 6 inches and approximately 10 inches.

The lateral middle second region 136B1' extends upwardly and around the outer upper leg of the user and corresponds to the musculature and connective tissues associated with the wearer's iliotibial band and knee. Thus, the application of the second material 120' in the second pattern 128' in the lateral middle second region 136B1' aligns and supports the musculature and connective tissues of the wearer's iliotibial band and knee. Additionally, the application of the second material 120' in the second pattern 128' in the lateral middle second region 136B1' acts as an elastic therapeutic tape, to slightly lift the user's skin around the iliotibial band and knee to facilitate firing of muscle fibers, facilitate lymphatic drainage, reduce inflammation, and improve blood flow.

The medial middle second region 136B2' is somewhat similar to the medial middle second region 136B2 described above and shown in FIGS. 1A, 1B, and 4C. As shown in FIG. 6D, the medial middle second region 136B2' differs from the medial middle second region 136B2 because the medial middle second region 136B2' extends along a greater length of the medial seam 106W. In particular, as shown in FIG. 1A, the medial middle second region 136B2 extends along the medial seam 106B for length L3, which is, for example, between approximately 0.25 inches and approximately 2 inches. As shown in FIG. 6D, however, the medial middle second region 136B2' extends along the medial seam 106B for length L4', which is, for example, between approximately 2 inches and approximately 5 inches.

The medial middle second region 136B2' extends upwardly and around the inner upper leg of the user and corresponds to the musculature and connective tissues associated with the wearer's inner knee and groin. Thus, the application of the second material 120' in the second pattern 128' in the medial middle second region 136B2' aligns and supports the musculature and connective tissues of the wearer's inner knee and groin. Additionally, the application of the second material 120' in the second pattern 128' in the medial middle second region 136B2' acts as an elastic therapeutic tape, to slightly lift the user's skin around the inner knee and groin to facilitate firing of muscle fibers, facilitate lymphatic drainage, reduce inflammation, and improve blood flow.

The Lower Second Regions

The lateral and medial lower second regions 136C1', 136C2' are somewhat similar to the lateral and medial lower second regions 136C1, 136C2 described above and shown in FIGS. 1A, 1B, and 4C. As shown in FIGS. 6A-6D, the lateral and medial lower second regions 136C1', 136C2' differ from the lateral and medial lower second regions 136C1, 136C2 because each of the lateral and medial lower second regions 136C1', 136C2' includes a first portion 230' and a second portion 234'. The first portions 230' of the medial and lateral lower second regions 136C1', 136C2' extend around the inner and outer lower leg of user in a direction generally perpendicular to the midline 101' of the garment 100' (shown in FIG. 6C). The first portions 230' of the medial and lateral lower second regions 136C1', 136C2' are separated from one another by a gap 238' and each of the first portions 230' extends from the gap 238' to the second portion 234'. The second portion 234' of the lateral lower second region 136C1' extends in a direction generally parallel to the lateral seam 106A', but is separated from the lateral seam 106A' by a portion of the fabric panel 104'. Similarly, the second portion 234' of the medial lower second region 136C2' extends in a direction generally parallel to the medial seam 106B', but is separated from the medial seam 106B' by a portion of the fabric panel 104'. Each of the second portions 234' extends from the respective first portion 230', in a direction away from the leg opening 126', for a length L5' that is, for example, between approximately 3 inches and approximately 5 inches.

The lateral lower second region 136C1' extends upwardly and around the outer ankle and lower leg of the user and corresponds to the musculature and connective tissues associated with the wearer's outer ankle and calf. Thus, the application of the second material 120' in the second pattern 128' in the lateral lower second region 136C1' aligns and supports the musculature and connective tissues of the wearer's outer ankle and calf. Additionally, the application of the second material 120' in the second pattern 128' in the lateral lower second region 136C1' acts as an elastic therapeutic tape, to slightly lift the user's skin around the outer ankle and calf to facilitate firing of muscle fibers, facilitate lymphatic drainage, reduce inflammation, and improve blood flow.

Similarly, the medial lower second region 136C2' extends upwardly and around the inner ankle and lower leg of the user and corresponds to the musculature and connective tissues associated with the wearer's inner ankle and calf. Thus, the application of the second material 120' in the second pattern 128' in the medial lower second region 136C2' aligns and supports the musculature and connective tissues of the wearer's inner ankle and calf. Additionally, the application of the second material 120' in the second pattern 128' in the medial lower second region 136C2' acts as an elastic therapeutic tape, to slightly lift the user's skin around the inner ankle and calf to facilitate firing of muscle fibers, facilitate lymphatic drainage, reduce inflammation, and improve blood flow.

Figure 9:
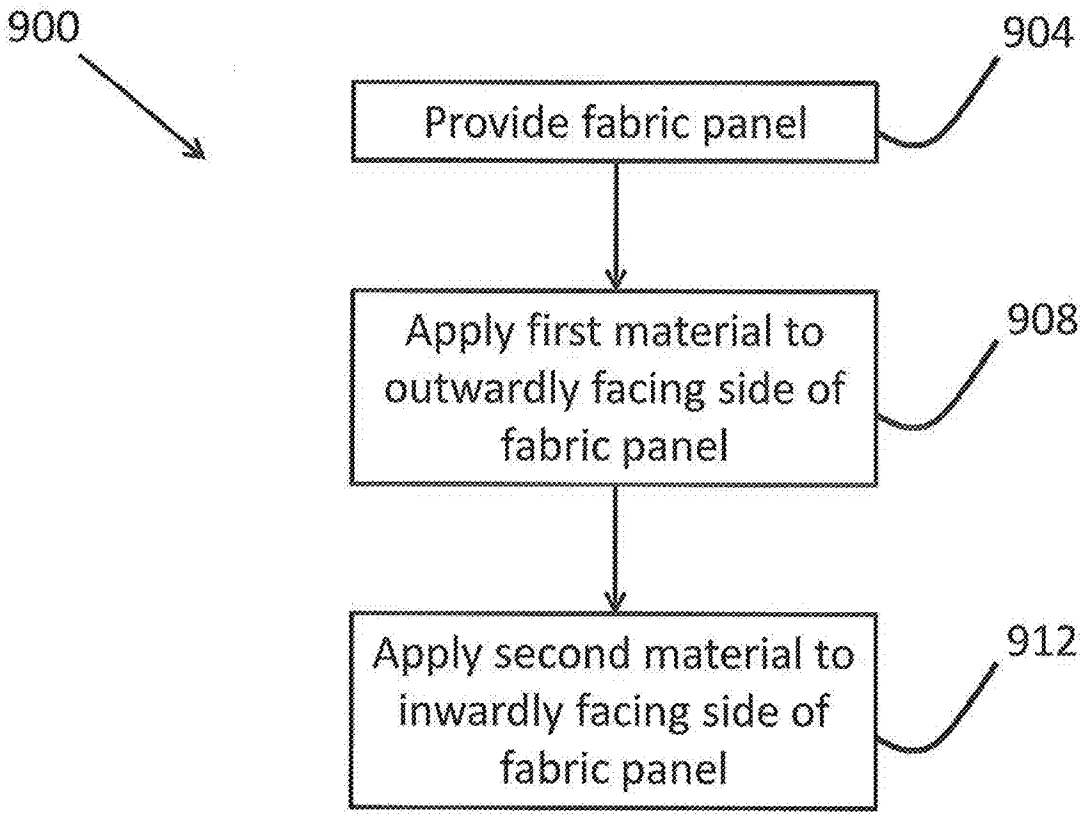
FIG. 9 is a flowchart of a method of producing a garment.

FIG. 9 depicts a flow chart of a method 900 for producing a garment to be worn on a part of the body, such as the garments 100, 100' discussed above. As shown in FIG. 9, the method 900 includes providing a fabric panel having an outwardly facing side and an inwardly facing side (904), applying a first material to the outwardly facing side of the fabric panel (908), and applying a second material to the inwardly facing side of the fabric panel (912). The outwardly facing side of the fabric panel faces away from the part of the body when the garment is worn, and the inwardly facing side of the fabric panel faces toward the part of the body when the garment is worn.

With the above-described configuration, a garment is provided having bimodal functionality. The material on the exterior side of the garment is patterned and position over large muscle groups, providing muscle damping on impact (e.g., foot strike). That is the exterior material increases compression of the apparel that, in turn, is capable of damping soft tissue vibrations, lowering muscle activity. Soft tissue vibrations are important for the energetics of running since muscle activity is required to damp these vibrations. The material on the interior of the apparel is patterned and positioned differently than that of the exterior layer, being configured to stabilize the joints and tendons. In addition, by contacting the skin, the material gently lifts the layer of skin and attached tissue covering a muscle to improve blood and fluid flow around that muscle. That is, as the athlete moves, material causes the skin and connective tissue (or fascia) over the muscle or tendon to move, pulling slightly away from the muscle and creating space for lymphatic fluid to flow.

The first material is applied to the outwardly facing side of the fabric panel (908) in a first repeating pattern in at least one first region of the fabric panel. Applying the first material to the fabric panel in this way selectively modifies a fabric modulus of elasticity of the fabric panel in the at least one first region. In particular, applying the first material to the fabric panel in the at least one first region increases the modulus of elasticity of the fabric panel in the at least one first region. In other words, the at least one first region has a first modulus of elasticity that is greater than the fabric modulus of elasticity of the fabric panel.

The second material is applied to the inwardly facing side of the fabric panel (912) in a second repeating pattern in at least one second region of the fabric panel. Applying the second material to the fabric panel in this way selectively modifies the fabric modulus of elasticity of the fabric panel in the at least one second region. In particular, applying the second material to the fabric panel in the at least one second region increases the modulus of elasticity of the fabric panel in the at least one second region. In other words, the at least one second region has a second modulus of elasticity that is greater than the fabric modulus of elasticity of the fabric panel.

In at least one embodiment of the method 900, applying the first material to the outwardly facing side of the fabric panel (908) in at least one first region of the fabric panel includes applying the first material in a plurality of first regions of the fabric panel. Similarly, in at least one embodiment of the method 900, applying the second material to the inwardly facing side of the fabric panel (912) in at least one second region of the fabric panel includes applying the second material in a plurality of second regions of the fabric panel.

In at least one embodiment of the method 900, applying the first material to the outwardly facing side of the fabric panel (908) includes printing the first material on the outwardly facing side of the fabric panel. The first material can be printed on the outwardly facing side of the fabric panel by, for example, screen printing, ink jet printing, laser printing, 3D printing, etc. Similarly, in at least one embodiment of the method 900, applying the second material to the inwardly facing side of the fabric panel (912) includes printing the second material on the inwardly facing side of the fabric panel. The second material can be printed on the inwardly facing side of the fabric panel by, for example, screen printing, ink jet printing, laser printing, 3D printing, etc.

In the embodiment of the method 900 shown in FIG. 9, the first material is applied to the outwardly facing side of the fabric panel (908) before the second material is applied to the inwardly facing side of the fabric panel (912). However, it will be recognized that, alternatively, the second material can be applied to the inwardly facing side of the fabric panel before the first material is applied to the outwardly facing side of the fabric panel.

In various embodiments of the method 900, the second material can be the same as or different from the first material. In at least one embodiment, the first material is different from the second material such that the first modulus of elasticity is greater than the second modulus of elasticity. However, it will be recognized that, alternatively, the first material can be different from the second material such that the first modulus of elasticity is less than the second modulus of elasticity. Additionally, in various embodiments of the method 900, the second repeating pattern can be the same as or different from the first repeating pattern.

Additionally, in various embodiments of the method 900, the at least one second region of the fabric panel can be the same as or different from the at least one first region of the fabric panel. In other words, the at least one first region of the fabric panel can entirely overlap the at least one second region of the fabric panel, the at least one first region of the fabric panel can partially overlap the at least one second region of the fabric panel, or the at least one first region of the fabric panel can have no overlap with the at least one second region of the fabric panel.

The foregoing detailed description of one or more exemplary embodiments of the garment has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. A garment to be worn on a part of a body, the garment comprising:

a fabric panel which has a fabric modulus of elasticity, the fabric panel including:

an inwardly facing side that faces toward the part of the body when the garment is worn; and an outwardly facing side that faces away from the part of the body when the garment is worn;

a first material applied to the outwardly facing side of the fabric panel, the first material forming a first pattern, the first pattern comprising at least one first unit having a first basic shape, wherein the first basic shape is repeated to form the first pattern, and wherein at least one portion of the first unit covers at least one first region of the fabric panel such that the garment is defined by a first modulus of elasticity in the at least one first region, the first modulus of elasticity being greater than the fabric modulus of elasticity, wherein the at least one first region wraps from an anterior side of the garment, across a lateral side of the garment, and to a posterior side of the garment; and a second material applied to the inwardly facing side of the fabric panel, the second material forming a second pattern, the second pattern comprising at least one second unit having a second basic shape that is different from the first basic shape, wherein the second basic shape is repeated to form the second pattern, and wherein at least one portion of the second unit covers at least one second region of the fabric panel such that the garment is defined by a second modulus of elasticity in the at least one second region, the second modulus of elasticity being greater than the fabric modulus of elasticity and different from the first modulus of elasticity, and wherein the at least one second region wraps from the anterior side of the garment, across the lateral side of the garment, and to the posterior side of the garment.

2. The garment of claim 1, wherein:

the first material and the second material are elastomeric polymer materials.

3. The garment of claim 1, wherein:

the at least one first region and the at least one second region do not overlap one another on the garment.

4. The garment of claim 1, wherein:

the at least one first region of the fabric panel includes:

at least one upper first region located above a knee, and at least one lower first region, which is spaced apart from the at least one upper first region and located below the knee.

5. The garment of claim 4, wherein:

the at least one first region of the fabric panel further includes at least one middle first region, which is arranged between the at least one upper first region and the at least one lower first region.

6. The garment of claim 3, wherein:

the at least one second region of the fabric panel includes:

at least one upper second region, and at least one lower second region, which is spaced apart from the at least one upper second region;

wherein the at least one first region is positioned between the at least one upper second region and the at least one lower second region.

7. The garment of claim 6, wherein:

the at least one second region of the fabric panel further includes at least one middle second region, which is arranged between the at least one upper second region and the at least one lower second region.

8. The garment of claim 1, wherein:

at least one of the first material and the second material is a polymer ink.

9. The garment of claim 1, wherein:

the second material is a silicone material.

10. A garment to be worn on a part of a body, the garment comprising:

a fabric panel, which has a fabric modulus of elasticity, the fabric panel including:

an inwardly facing side that faces toward the part of the body when the garment is worn; and an outwardly facing side that faces away from the part of the body when the garment is worn;

a first material applied to the outwardly facing side of the fabric panel in at least one first region, the at least one first region having a first modulus of elasticity that is greater than the fabric modulus of elasticity; and a second material applied to the inwardly facing side of the fabric panel in at least one second region, the at least one second region having a second modulus of elasticity that is greater than the fabric modulus of elasticity, and wherein the first modulus of elasticity is greater than the second modulus of elasticity.

11. The garment of claim 10, wherein:

the first material is applied in the at least one first region in a first pattern comprising at least one first unit having a first basic shape, wherein the first basic shape is repeated to form the first pattern;

the second material is applied in the at least one second region in a second pattern comprising at least one second unit having a second basic shape, wherein the second basic shape is repeated to form the second pattern; and wherein a composition of the first material is different from a composition of the second material.

12. The garment of claim 10, wherein:

the at least one first region and the at least one second region do not overlap one another on the garment, wherein the at least one first region wraps from an anterior side of the garment, across a lateral side of the garment, and to a posterior side of the garment, and wherein the at least one second region wraps from the anterior side of the garment, across the lateral side of the garment, and to the posterior side of the garment.

13. A method of producing a garment to be worn on a part of a body, the method comprising:

selectively modifying a modulus of elasticity of a fabric panel of the garment in at least one first region by applying a first material in a first repeating pattern to an outwardly facing side of the fabric panel in the at least one first region such that the modulus of elasticity of the fabric panel of the garment in the at least one first region is increased to a first modulus of elasticity; and selectively modifying the modulus of elasticity of the fabric panel of the garment in at least one second region by applying a second material in a second repeating pattern to an inwardly facing side of the fabric panel in the at least one second region such that the modulus of elasticity of the fabric panel of the garment in the at least second first region is increased to a second modulus of elasticity that is different than the first modulus of elasticity, wherein:

the outwardly facing side of the fabric panel faces away from the part of the body when the garment is worn, and the inwardly facing side of the fabric panel faces toward the part of the body when the garment is worn.

14. The method of claim 13, wherein:

applying the first material includes printing the first material on the outwardly facing side of the fabric panel; and applying the second material includes printing the second material on the inwardly facing side of the fabric panel.

15. The method of claim 13, wherein at least a portion of the at least one first region and at least a portion of the at least one second region do not overlap one another.

16. The method of claim 13, wherein:

the at least one first region includes a plurality of first regions; and the at least one second region includes a plurality of second regions.

17. The method of claim 13, wherein:

the first material is a different material than the second material, and the first repeating pattern is different than the second repeating pattern.

18. The method of claim 13, wherein the at least one first material is applied to the garment such that the at least one first region wraps from an anterior side of the garment, across a lateral side of the garment, and to a posterior side of the garment, and wherein the at least one second material is applied to the garment such that the at least one second region wraps from the anterior side of the garment, across the lateral side of the garment, and to the posterior side of the garment.

19. The garment of claim 1, wherein:

the first modulus of elasticity is greater than the second modulus of elasticity.

20. The garment of claim 1, wherein:

the second modulus of elasticity is greater than the first modulus of elasticity.

* * * * *